US005349321A

United States Patent [19]

Selker

[11] Patent Number: 5,349,321

[45] Date of Patent: Sep. 20, 1994

[54] POWERCORD TRANSFORMER

[75] Inventor: Edwin J. Selker, San Jose, Calif.

[73] Assignee: International Business Machines Corporation, Armonk, N.Y.

[21] Appl. No.: 4,381

[22] Filed: Jan. 14, 1993

[51] Int. Cl.[5] ..... H01F 19/00

[52] U.S. Cl. ..... 336/221; 336/20; 336/83; 336/107

[58] Field of Search ..... 336/221, 20, 83, 105, 336/107, 220, 234

[56] References Cited

U.S. PATENT DOCUMENTS

| | | | |
|---|---|---|---|
| 2,436,742 | 2/1948 | Bussey | 336/107 |
| 2,637,205 | 5/1953 | Miller | 336/20 |
| 2,889,523 | 6/1959 | Henderson | 336/221 |
| 3,327,253 | 6/1967 | Campbell . | |
| 4,321,572 | 3/1982 | Studer et al. | 336/83 |
| 4,519,015 | 5/1985 | Lin | 361/399 |
| 4,631,841 | 9/1986 | Roberts | 336/83 |
| 4,939,623 | 7/1990 | Equi et al. | 361/399 |

*Primary Examiner*—Gerald P. Tolin
*Assistant Examiner*—L. Thomas
*Attorney, Agent, or Firm*—Heslin & Rothenberg

[57] ABSTRACT

An elongated ferromagnetic core is surrounded by two windings. Optional separators separate the core from the windings and one winding from the other winding. A tube-like ferromagnetic sheath covers the windings and core. The sheath and core are connected, preferably at both ends. At one end, one winding may be connected to a plug for connecting to a wall outlet for supplying an alternating current thereto. At the other end, the other winding may be connected to an external load for providing a voltage thereto. Optionally, an electrically insulating, thermally conductive, outer cover covers the ferromagnetic sheath. In a first embodiment, one winding is surrounded by the other winding. In a second embodiment, one winding surrounds a portion of the core and the other winding surrounds another portion of the core.

6 Claims, 2 Drawing Sheets

POWERCORD TRANSFORMER

BACKGROUND OF THE INVENTION

1. Technical Field

The present invention relates generally to power supplies. More particularly, the present invention relates to transformers.

2. Background Art

Many electrical devices have a power supply which includes a portable transformer. As is known in the art, a power supply generally includes a transformer, a rectifier and a filter. A popular type of transformer takes the form of a box which may have prongs that plug into a wall outlet, or which may have a cord extending to a wall outlet and another cord extending to the device.

Box-type transformers provide several advantages. Electrical noise is isolated outside the device, rather than including the entire power supply as part of the device. Potentially dangerous voltage is isolated outside the device. In addition, heat from the transformer is isolated away from the device.

However, such transformers also have several disadvantages. With very large box transformers, the heat generated may require a system for cooling. Often, the cooling system utilizes chemical coolants, such as freon, to cool the transformer. Such chemical coolants may be potentially dangerous to the environment. In addition, cooling systems may add to the cost of the power supply and/or the device(s) it is associated with. With smaller box transformers, the major disadvantage is inconvenience. For portable devices, a box transformer can be cumbersome to transport. Smaller box transformers may also be forgotten, rendering the devices useless. Also, plug-in box transformers often fall out of the electrical outlet due to their own weight. In addition, the box-type plug-in transformer may cover up other outlets.

Another type of transformer potentially solves the problems associated with box-type transformers. Transformers shaped like appliance powercords are being re-examined. These transformers do not suffer from the disadvantages associated with box-type transformers. Heat is dissipated along the length of the transformer, rather than being concentrated in one place. Assuming a powercord transformer is attached to a portable device, it cannot be forgotten in transport. As a conventional plug can be used with a powercord transformer, other outlets are not covered up. In addition, since a powercord transformer's weight is dispersed over its length, the possibility of it falling out of the outlet is greatly reduced.

In the prior art, cord-like transformers, hereinafter referred to as powercord transformers, are highly inefficient and may not work. One example of a powercord transformer is described in U.S. Pat. No. 2,436,742, issued to Bussey. Disclosed there is a combination transformer and powercord. However, the Bussey powercord transformer, referred to therein as a line cord transformer, fails to provide a reliable return path for the magnetic flux produced in the core. Presumably, although not disclosed therein, Bussey utilizes air as a return flux path to induce a voltage in the secondary winding. Given that air has a low permeability ($\mu$), it is a distinct possibility that no voltage or an insufficient voltage will be induced in the secondary winding. For example, a flux path consisting of iron or various iron alloys has a $\mu$ of from 50 to 200,000, compared to air which has a $\mu$ of 1.

Thus, a need exists for a reliable, efficient powercord transformer that does not need a cooling system and is convenient to use.

DISCLOSURE OF THE INVENTION

Briefly, the present invention satisfies the need for a reliable, efficient and convenient powercord transformer through the addition of a return path for the magnetic flux produced in the core, without the need for a cooling system.

In a powercord transformer according to the present invention, a first winding and a second winding are wound around an elongated ferromagnetic core. A ferromagnetic sheath covers both windings and the core, and is attached to the core. The core and sheath create a complete magnetic circuit.

These, and other objects, features and advantages of this invention will become apparent from the following detailed description of the presently preferred embodiments of the invention taken in conjunction with the accompanying drawings.

BEST MODE FOR CARRYING OUT THE INVENTION

Figure 1A:
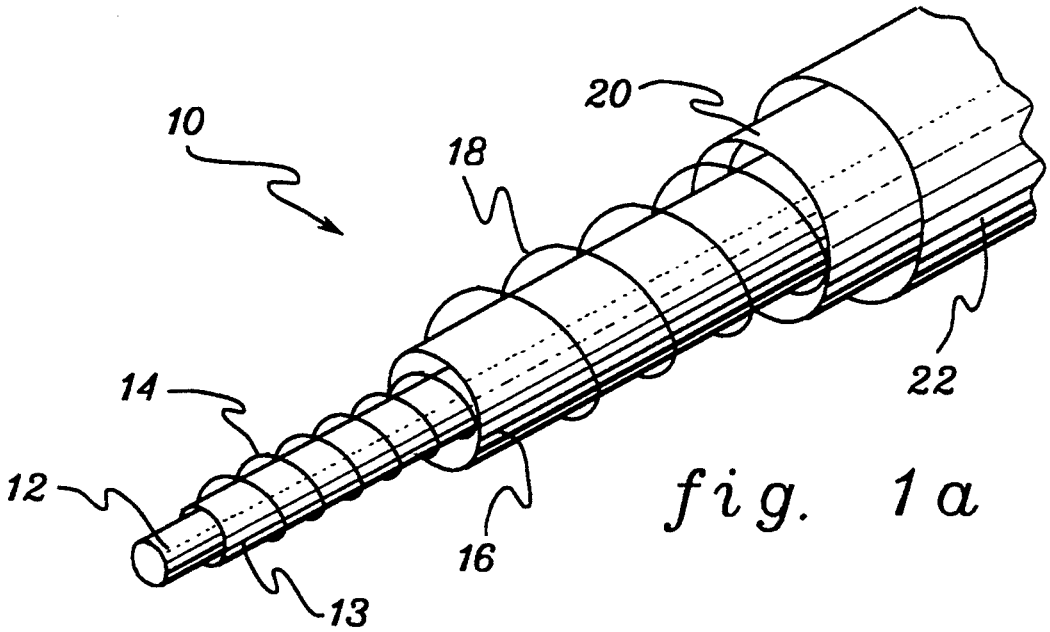
FIG. 1*a* depicts a cut-away powercord transformer according to a first embodiment of the present invention.

FIG. 1*a* provides a cut-away depiction of powercord transformer 10 according to a first embodiment of the present invention. Elongated core 12 is surrounded by primary winding 14. Typically, transformer windings are helically wound around a transformer core. Optionally, core 12 and winding 14 may be separated by insulator 13. Core 12 may be as long or short as a given electrical device powercord needs to be, for example, six feet. Core 12 could be made from any of a number of ferromagnetic materials. Some examples of possible ferromagnetic materials include iron, having a $\mu$ of about 4000, or silicon steel, which has a $\mu$ of about 50. Preferably, core 12 is made of PERMALLOY, a high permeability alloy of iron and nickel, which has a $\mu$ of about 200,000.

Figure 1B:
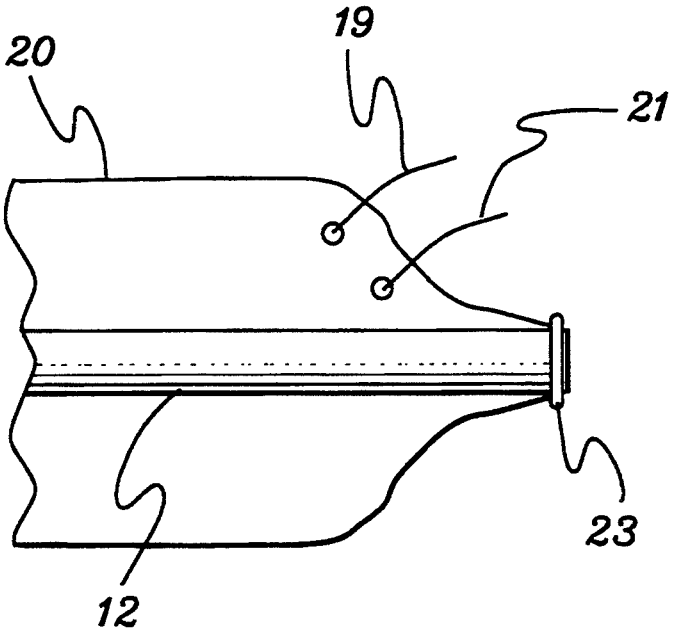
FIG. 1*b* depicts one end of the powercord transformer of FIG. 1*a* with a clamp connecting the sheath and core.
Figure 1C:
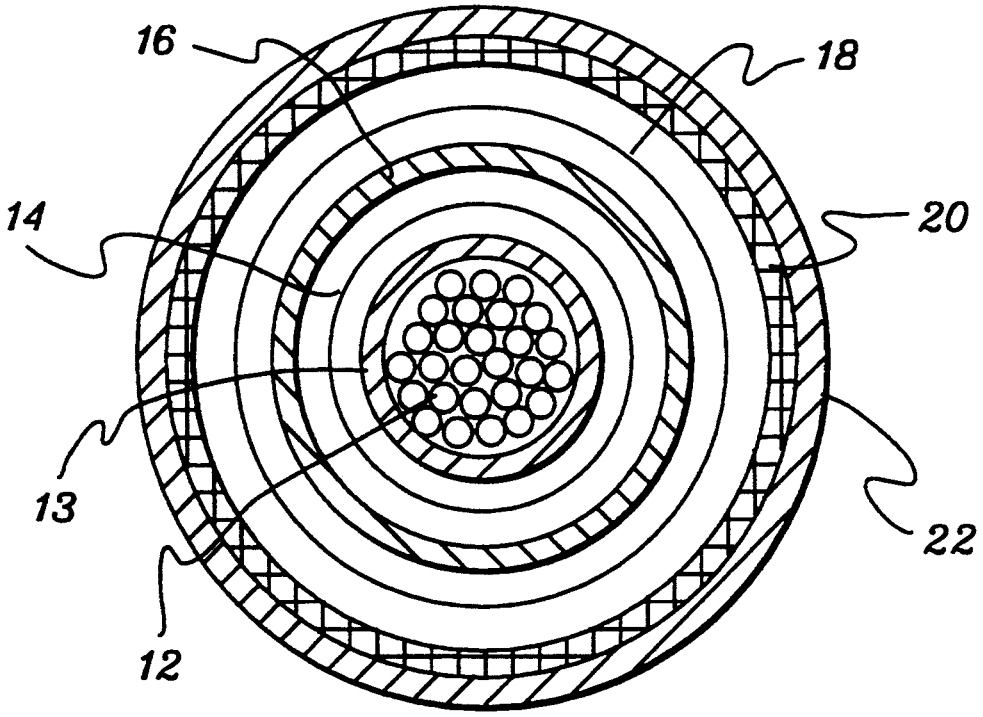
FIG. 1*c* is a cross-sectional view of the powercord transformer of FIG. 1*a* with a core and sheath comprising multiple ferromagnetic strands.

Surrounding primary winding 14 is optional separator 16, which may be an electrical insulator. Secondary winding 18 surrounds separator 16. Sheath 20, made of a ferromagnetic material, preferably PERMALLOY, a high permeability alloy of iron and nickel surrounds secondary winding 18 and is connected to core 12, such that a complete magnetic circuit is created. As examples, sheath 20 and core 12 could be welded or clamped together at both ends to connect them. FIG. 1*b* depicts one end of powercord transformer 10 with a clamp 23 connecting core 12 and sheath 20, as well as wires 19 and 21 which correspond to one of the windings.

Preferably, powercord transformer 10 includes a covering 22 for protecting the transformer, and may comprise rubber or standard electrical wire insulation. Covering 22 is also preferably thermally conductive for heat dissipation. It will be understood that winding 14 could be a secondary winding and winding 18 could be a primary winding. It will also be understood that there could be more than two windings, or multiple taps on the primary winding.

Powercord transformer 10 is preferably flexible. To facilitate flexibility, core 12 could be made of a bundle of thin strands of ferromagnetic material. Preferably, the strands are separated from one another by, for example, coating each strand. Sheath 20 may also comprise a number of separated, thin ferromagnetic strands for flexibility. Preferably, sheath 20 comprises such strands arranged in a biased weave; that is, an angled weave pattern. FIG. 1*b* is a cross-sectional view of transformer 10, showing core 12 as a bundle of thin ferromagnetic strands and sheath 20 as a layer of thin ferromagnetic strands arranged in a biased weave.

As is known in the art, an alternating current in primary winding 14 induces a magnetic field around core 12 and magnetic flux in core 12. The magnetic flux returns through sheath 22, causing an alternating voltage across the terminals of secondary winding 18 and a current to flow in an external load connected to the terminals of secondary winding 18. It will be understood that powercord transformer 10 could be used in a switching power supply with feedback to control the output voltage.

Figure 2:
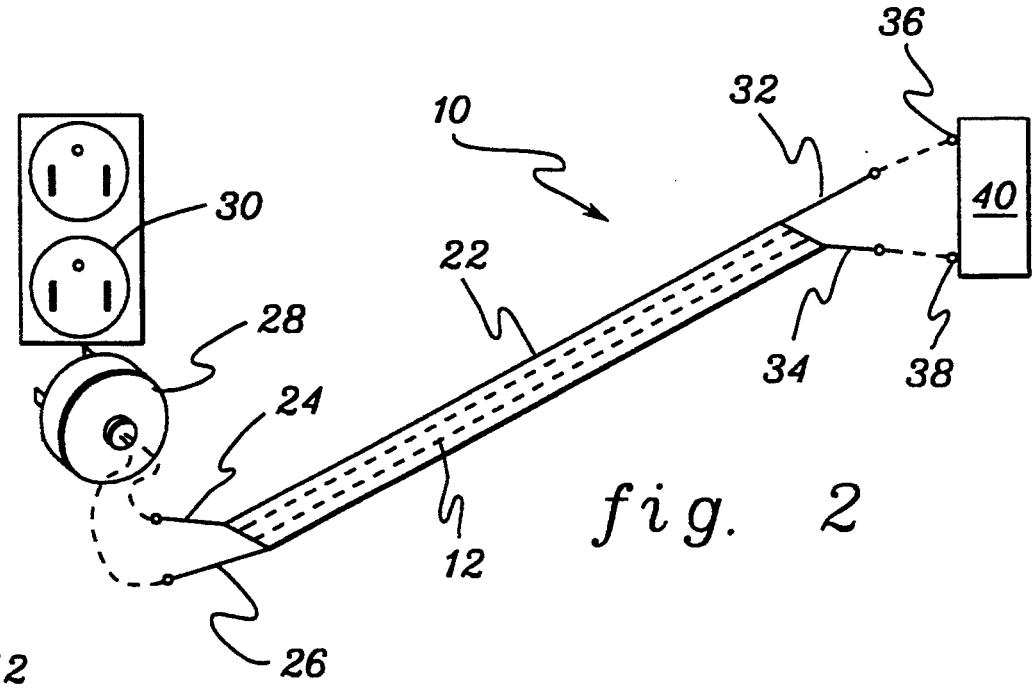
FIG. 2 depicts the powercord transformer of FIG. 1*a* with a source of alternating current and a load.

FIG. 2 depicts one example of how powercord transformer 10 can be used. Primary winding 14 has two terminal ends, 24 and 26. One way to achieve terminal ends 24 and 26 being accessible at the same end, as is known in the art, is to double-wind winding 14. That is, winding 14 is helically wound from one end of core 12 to the other and back again, creating two winding layers. Primary terminal ends 24 and 26 are connected as shown to plug 28, which is inserted into wall outlet 30 to provide a source of alternating current. At the other end of powercord transformer 10 are secondary terminal ends 32 and 34 of secondary winding 18. Ends 32 and 34 are connected as shown to terminals 36 and 38 of load 40. Load 40 could be, for example, an electrical appliance or a circuit. If, for example, load 40 required a lower voltage than the standard voltage available at outlet 30, powercord transformer 10 would act as a step-down transformer. It will be understood that powercord transformer 10 could also be a step-up transformer by changing the turns ratio (number of primary turns over number of secondary turns), as is known in the art.

Transformers normally dissipate heat; the heat increasing with the size of the transformer. As previously noted, very large box transformers, such as those at power stations, often require a cooling system which may include potentially environmentally hazardous chemicals. The powercord transformer of the present invention allows even large transformers to air cool, as the heat is dissipated along the length of the powercord, rather than concentrated in one area.

Figure 3:
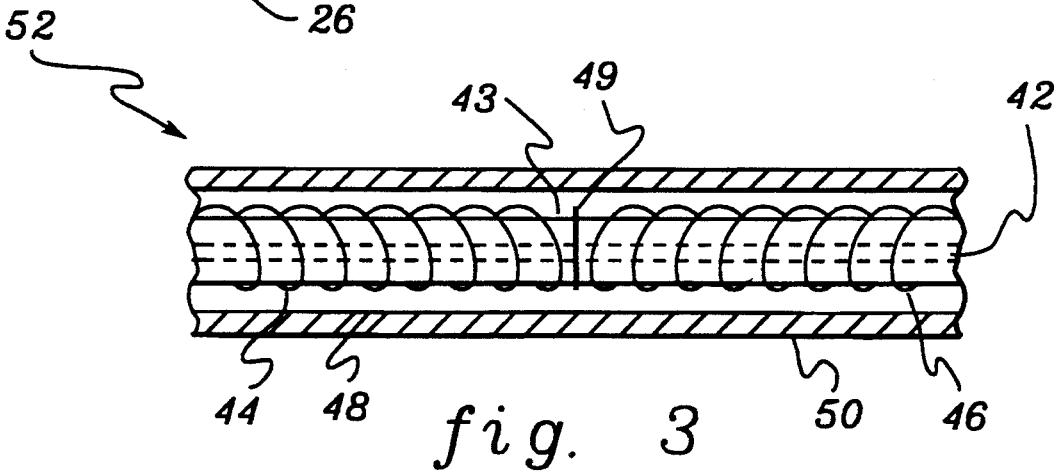
FIG. 3 presents a cross-sectional view of a portion of a powercord transformer according to a second embodiment of the present invention.

FIG. 3 is a partial cross-sectional view of a powercord transformer according to a second embodiment of the present invention. Shown there is elongated ferromagnetic core 42 surrounded by optional separator 43. Winding 44 is helically wound around one half of core 42, and winding 46 is helically wound around the other half of core 42. Windings 44 and 46 comprise electrically conductive wire, for example, copper wire. It will be understood that one winding will act as a primary winding and the other as a secondary. It will also be understood that a given winding could be wound around more or less than half the core. Sheath 48 is also made of ferromagnetic material and surrounds core 42 and windings 44 and 46. Optionally, windings 44 and 46 are separated by a separator 49 which may comprise an electrical insulator. Preferably, core 42 and sheath 48 comprise PERMALLOY, a high permeability alloy of iron and nickel, as the ferromagnetic material. Sheath 48 and core 42 are connected, preferably at both ends of powercord transformer 52. As in the first embodiment, shown in FIG. 1*b* , such connections could be, for example, via welding or clamping. An outer protective covering 50 may be included. Preferably, covering 50 is both electrically insulating and thermally conductive. As in the first embodiment, powercord transformer 52 is preferably flexible. It will be understood that there may be more than two windings, or multiple taps on the primary winding.

It should be noted that the second embodiment may not be as efficient as the first embodiment as the ratio of powercord transformer length to diameter increases. This potential difference in efficiency stems from the fact that the higher the powercord transformer ratio is in the second embodiment, the less optimum is the magnetic coupling between the primary and secondary winding. However, the second embodiment provides an electrical isolation safety feature that may outweigh the decrease in efficiency compared to the first embodiment for certain high-power applications. If powercord transformer 52 is cut at any point along its length, no shorting can take place. Thus, although the first embodiment provides maximum efficiency, the second embodiment provides maximum safety. The choice between the embodiments will depend on the application. For example, a powercord transformer according to the second embodiment is ideal for use as a current sensor.

While presently preferred embodiments of the invention have been described and depicted herein, alternative embodiments may be effected by those skilled in the art to accomplish the same objectives. Accordingly, it is intended by the appended claims to cover all such alternative embodiments as fall within the true spirit and scope of the invention.

I claim:

1. A powercord transformer, comprising:

an elongated core comprising ferromagnetic material;

a first winding surrounding said core;

a second winding surrounding said core, wherein said first winding and said second winding are stationary relative to one another and wherein said first winding surrounds a first portion of said core and said second winding surrounds a second portion of said core;

a sheath comprising ferromagnetic material surrounding said core, said first winding and said second winding; and means for connecting said sheath to said core, such that a complete magnetic circuit is created.

2. A powercord transformer, comprising:

an elongated core comprising ferromagnetic material;

a first winding surrounding said core;

a second winding Surrounding said core, wherein said first winding and said second winding are stationary relative to one another;

a sheath comprising ferromagnetic material surrounding said core, said first winding and said second winding;

means for connecting said sheath to said core, such that a complete magnetic circuit is created; and means for separating said core from said first winding and said second winding.

3. A flexible powercord transformer comprising:

an elongated flexible core comprising ferromagnetic material;

a first winding surrounding said elongated flexible core;

a second winding surrounding said elongated flexible core;

a flexible sheath comprising ferromagnetic material surrounding said elongated flexible core, said first winding and said second winding; and means for connecting said sheath to said core, such that a complete magnetic circuit is created.

4. The powercord transformer of claim 3, wherein said core comprises a plurality of ferromagnetic strands.

5. The powercord transformer of claim 3, wherein said sheath comprises a plurality of ferromagnetic strands.

6. The powercord transformer of claim 4, wherein said plurality of ferromagnetic strands are arranged in a biased weave.

* * * * *